US005438784A

United States Patent [19]

Lenkarski et al.

[11] Patent Number: 5,438,784

[45] Date of Patent: Aug. 8, 1995

[54] MAGAZINE SAFETY

[75] Inventors: Lee M. Lenkarski, Ware; Pardip K. Vaid, Northampton, both of Mass.

[73] Assignee: Smith & Wesson Corp., Springfield, Mass.

[21] Appl. No.: 293,046

[22] Filed: Aug. 19, 1994

[51] Int. Cl.[6] ..... F41A 17/36

[52] U.S. Cl. ..... 42/70.02; 42/70.08; 42/70.05

[58] Field of Search ..... 42/70.02, 70.08, 70.05; 89/137, 149

[56] References Cited

U.S. PATENT DOCUMENTS

| | | | |
|---|---|---|---|
| 1,143,471 | 6/1915 | Whiting | 89/137 |
| 1,234,961 | 7/1917 | Tansley | 89/137 |
| 2,296,998 | 9/1942 | Koehler | 89/137 |
| 3,857,325 | 12/1974 | Thomas | 89/137 |
| 4,031,648 | 6/1977 | Thomas | 89/137 |

FOREIGN PATENT DOCUMENTS

| | | | |
|---|---|---|---|
| 648817 | 12/1928 | France | 42/70.02 |

*Primary Examiner*—Stephen M. Johnson
*Attorney, Agent, or Firm*—Chapin, Neal & Dempsey

[57] ABSTRACT

A magazine safety for a semi-automatic pistol with a double-action firing pin striker mechanism having a lever pivotable to the frame of said pistol so that the forward end thereof will sense the presence of the magazine in the pistol. The lever is provided with a downwardly opening recess on its underside and a spring disposed to urge the lever to engage a pin extending laterally from the sear of the firing mechanism of said pistol. The pistol further includes a trigger bar movable in response to the trigger and is engageable with the sear for cocking and releasing the firing pin to fire the pistol. When engaged with a sear pin, the recess in the lever serves to prevent movement of the sear for firing the pistol whenever the magazine has been removed from the pistol. The lever having its center of gravity disposed to ensure that the lever will engage the sear to prevent firing of the pistol even in the event the safety spring is rendered inoperable.

3 Claims, 2 Drawing Sheets

MAGAZINE SAFETY

FIELD OF THE INVENTION

This invention relates to magazine safety mechanisms for semi-automatic pistols and more particularly to a magazine safety adapted to prevent the firing of a double action firing mechanism whenever the magazine is not disposed in the magazine chamber of the pistol.

BACKGROUND OF THE INVENTION

To those acquainted with the operation of semi-automatic pistols, the unintentional discharge of live rounds remaining in the chambers of such guns after removal of the magazine from the gun, has been an all too familiar story and often with unintended and tragic consequences. Recently, such unintentional firings appear to have increased in frequency and are believed to be due in part to the recent increase in the popularity of "ready-to-fire" double action semi-automatic pistols.

U.S. Pat. No. 4,031,648, which typifies the prior art magazine safety mechanisms, discloses a magazine safety in the form of a cantilever 62 which is pivotably mounted at one end, adjacent the after-end of the frame and a torsion spring 73 urges the forward end of the lever 62 downwardly so that in effect it monitors the presence or absence of a magazine in the handgrip of the pistol. With this arrangement, whenever the magazine 83 is removed from the magazine chamber of the handgrip of the gun, the safety lever 62 will be moved downwardly to engage and force the trigger bar 34 downwardly against the upward bias of the trigger spring 36. Conversely, whenever a magazine is inserted into the magazine chamber of the gun, the lever 62 will be deflected upwardly enabling the spring 36 to bias the trigger bar upward. In that way, the sear 42 that extends upwardly of the rear end of the trigger bar can engage the firing pin sear 43 that extends downwardly from the firing pin 21 to cause the gun to be fired. On the other hand, when the magazine is removed from the gun, the safety lever 62 will force the trigger bar downward so that it cannot fire the gun because the sear 42 will be disposed at a level below that of the firing pin sear 43 so that the firing pin 21 cannot be cocked and released by the trigger bar 34, as is required for firing the gun. This arrangement will thus prevent the unintentional discharge of a round being in the chamber of the gun when the magazine is removed.

Among the drawbacks of the magazine safety over the prior art, as exemplified by the above-referenced Pat. No. 4,031,648 is that the safety spring 73 must have sufficient force to ensure that it will be capable of overcoming the upward component of force imparted to the trigger bar by trigger spring 36. Any failure or weakness of the safety spring 73 will result in the safety failing in an unsafe condition. In that connection, moreover, there would be no indication to the user of the gun whether or not the magazine safety is operative inasmuch as in either case, the trigger bar would be moveable in response to actuation of the trigger. As a result, one using such a gun could easily be mislead into believing that the safety is operative, when in fact it may not be.

The principal object of this invention is to provide a magazine safety mechanism that is simple, compact and reliable in operation and which overcomes the drawbacks of the prior art.

Another object of this invention is to provide a magazine safety in a pistol having a double action, striker-firing pin type firing mechanism.

A further object of this invention is to provide a magazine safety mechanism which is "fail safe" in operation.

In accordance with this invention, a magazine safety is provided in a pistol having a double action, striker-firing pin type firing mechanism. The trigger is connected by a trigger bar to move a pivotable sear which in turn causes the firing pin to move rearwardly to compress the firing pin spring until the firing pin is fully cocked and then released thereby. The sear includes a laterally extending pin releasably engageable by the trigger bar to control the cocking and release of the firing pin. The magazine safety comprises a lever pivotably mounted adjacent its rear end to the frame of the gun and with a spring urging the lever downwardly so that a forward end portion of said lever is continually urged by the force of gravity and said spring toward a position for engaging a portion of the magazine when positioned in the pistol or is being inserted therein. A downwardly opening recess is provided at the outer end portion of the lever to engage the laterally extending pin of the sear to prevent movement of or to "lock" the firing pin against being cocked or released to fire the pistol whenever there is no magazine disposed in the pistol.

The above and other objects and advantages of this invention will be more readily apparent from a reading of the claims in light of the specific and with reference to the accompanying drawings in which:

DETAILED DESCRIPTION OF THE PREFERRED EMBODIMENT

Figure 1:
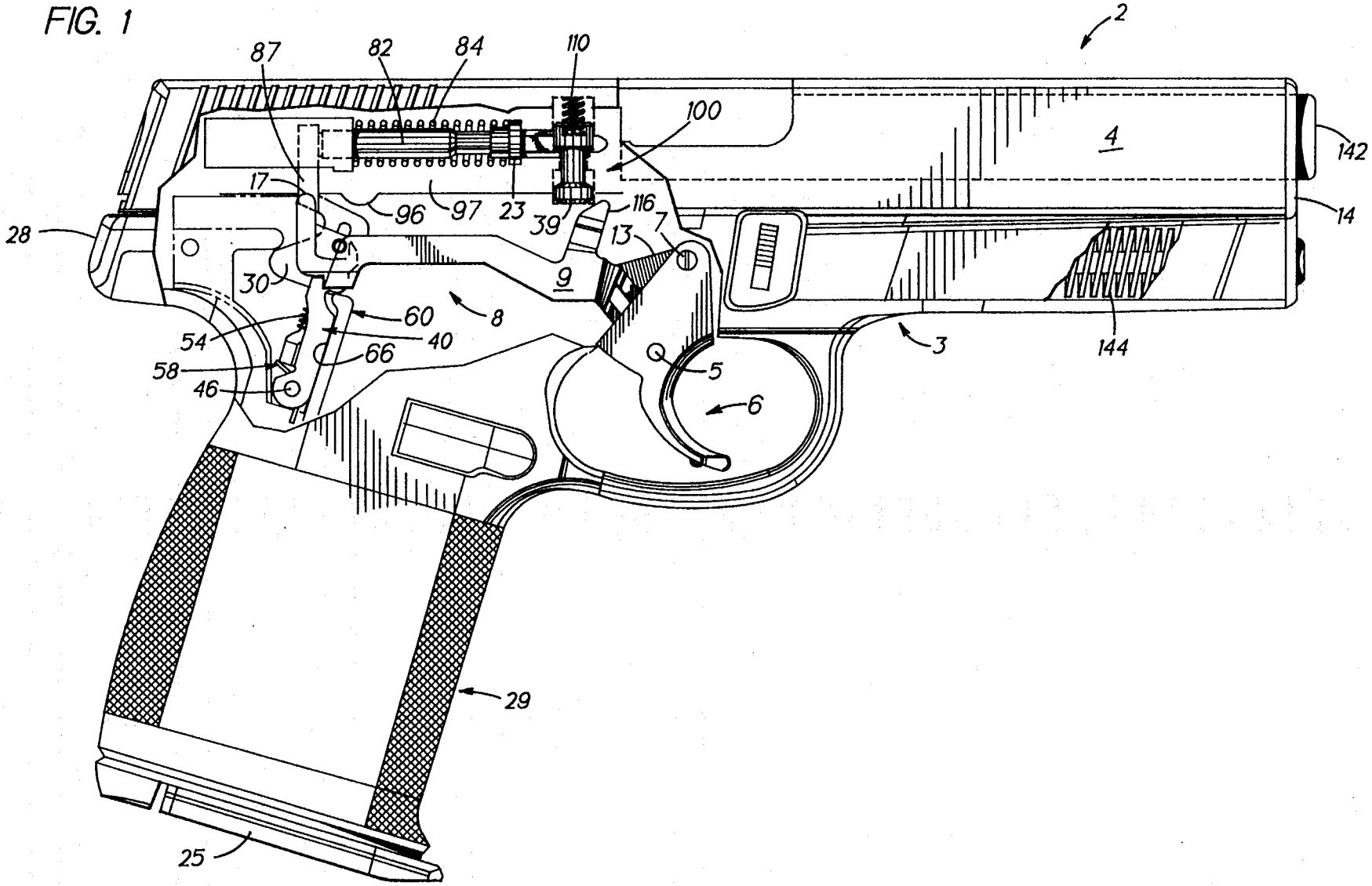
FIG. 1 is an elevational view of a semi-automatic pistol equipped with a magazine safety mechanism of the type embodying this invention shown in combination with a striker-fire mechanism.

Referring to FIG. 1, a semi-automatic pistol or handgun or pistol 2 is shown and generally comprises a frame 3, slide 4, a fire control mechanism 8 and a magazine safety 10 of the type embodying the present invention.

Figure 3:
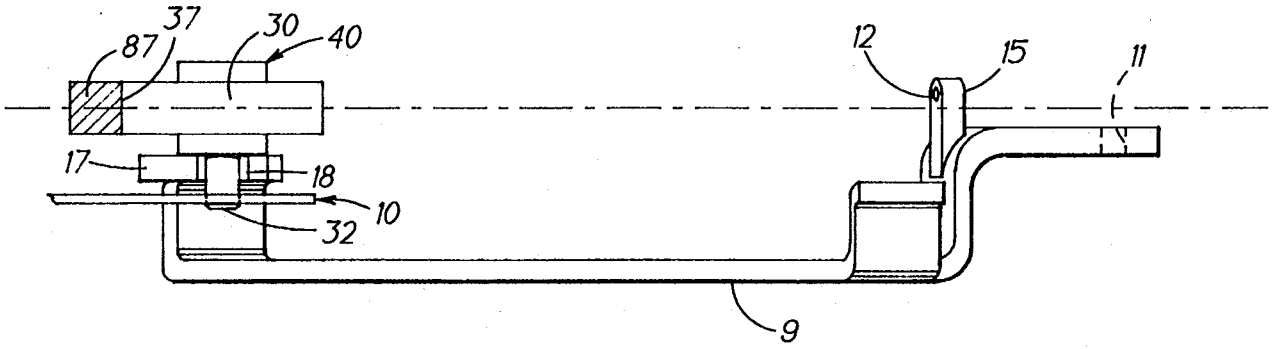
FIG. 3 is a top plan view of the magazine safety shown engaged with the sear.

The fire control mechanism 8, as shown and described in a copending patent application, Ser. No. 08/168,148 filed on Dec. 17, 1993, assigned to the same assignee as this application, is hereby incorporated by reference. Generally, the mechanism comprises a trigger 6 pivotable for moving a trigger bar 9 longitudinally in response to operation of the trigger. When one actuates the trigger, it will move rearward about the pivot pin 7 and its pivotable movement will be transmitted to the trigger bar 9 by a pin 5. An expansion type coil spring 13 serves as the trigger spring secured at one end to the pivot pin 7 of the trigger and its other end to a hole 12 provided through a spring mounting arm 15 which extends transversely of the trigger bar 9 (FIG. 3). Rearward movement of the trigger bar 9 will cause the spring 13 to be expanded and a pivotable sear 30 to be moved sufficiently to cause compression and then release the firing pin spring 84 which thrust the firing pin 82 forwardly to fire a round in the chamber of the pistol or gun 2. Upon firing, recoil of the gun will cause disconnect arm 17 to be deflected downwardly by the slide 4 so that the sear 30 will no longer be engaged by the trigger bar 9. A sear spring 58 and coil spring 54 thereby reposition the sear 30 to its forward or "ready" position for the next firing cycle.

Figure 4:
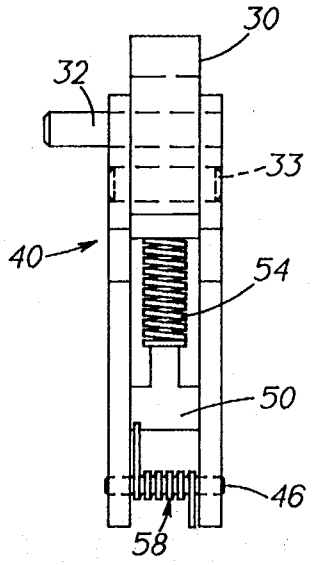
FIG. 4 is an elevational view of a sear of the type that may be used in the apparatus of this invention.
Figure 2:
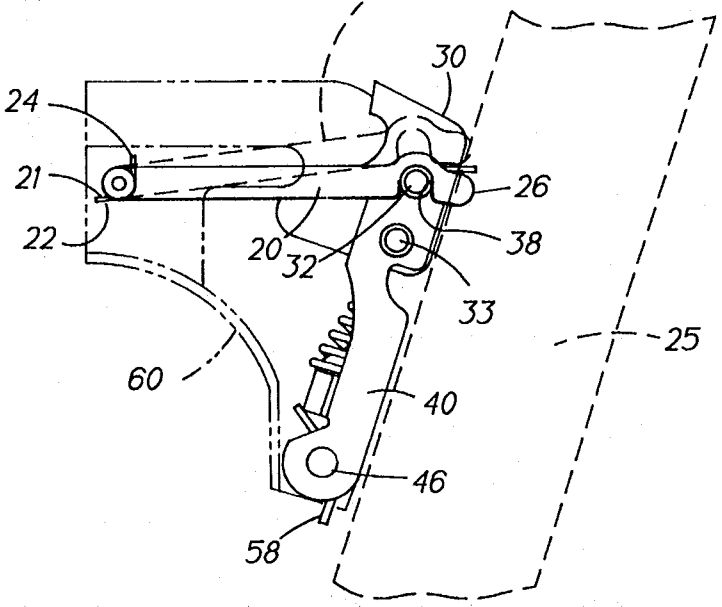
FIG. 2 is an elevational view of the safety of FIG. 1 on an enlarged scale with the magazine removed from the gun.

Referring now to FIGS. 1–3, the trigger bar 9 is pivotably connected at one end to the trigger 6 by pin 5 fitted into a hole 11 (FIG. 3) adjacent the forward end of the trigger bar 9. The trigger bar includes, adjacent its after-end, an upwardly open U-shaped hook 18 that serves to interengage with sear pin 32 (FIGS. 2 and 4) for moving the sear 30 rearward to cock and then release the firing pin 82 to fire the gun. As the trigger is pivoted clockwise about the pivot pin 7, the trigger bar 9 connected to the trigger 6 by pin 5, will move toward the rear of the gun. This motion will cause spring 13 to be expanded and thus tensioned to urge the trigger bar 9 forwardly for return to its forward position after each round is fired.

As shown in FIGS. 1–4, the sear mechanism comprises a sear 30 of generally rectangular overall plate-like configuration. The sear is carded by a pivot or swing arm 40 adapted to pivot about a pin 46. A compression coil spring 54 biases the sear 30 upwardly and a torsion or sear spring 58 is disposed about pivot pin 46 for urging the pivot arm 40 to its forward position. Both the trigger spring 13 and the sear spring 58 oppose the trigger pull for firing the gun. The pivot arm 40 comprises laterally spaced side walls disposed and secured in spaced parallel relation by transverse pin 32 and lower transverse wall or cross-bar member 50. A second transverse pin 33 is disposed in vertically spaced relation below the sear pin 32. The two pins 32 and 33 serve to guide and limit the movement of the sear 30 longitudinally within the pivot arm 40. The pivot arm 40 is fitted within the stationary sear housing 60 and secured thereto by the pivot pin 46. The sear housing 60 is fitted into the frame 4 by a transverse pin 27.

In FIG. 1 is shown a magazine safety mechanism at 10 of the type embodying this invention. The mechanism comprises a lever 20 disposed on the pin 27 for pivotable movement in a vertical plane adjacent its outer end. The pin is fitted into laterally spaced holes in the frame 4 having a muzzle, or front end 14, and a rear end as at 28 and a torsion spring 21 is fitted about the pin and includes leg portions 22 and 24 which urge the lever 20 in a clockwise direction, as depicted in FIGS. 1 and 2, so that its nose or forward end portion 26 is disposed to engage an tipper edge portion of the magazine 25 when inserted in a downwardly opening magazine chamber provided in the grip 29 of the frame for releasably receiving therein the magazine 25.

The safety lever 20 includes a downwardly opening recess 38 adapted to engage the pin 32 that extends from the swing arm 40 in which the sear 30 is disposed for pivotable movement. The result is that the swing arm 40 cannot be pivoted by actuation of the trigger 6 so that rearward movement of the trigger bar 9, required to fire the gun, will not occur. Further, the sear 30 cannot be moved to release the leg 87 that depends downward from the firing pin. The same result will be obtained whenever one attempts to fire the gun with the magazine 25 (FIG. 2) being removed from the gun, even in unlikely events when either or both the trigger spring 13 and safety spring 21 should fail. The "fail safe" operation of the safety mechanism 10 is achieved by the cantilever arrangement of the safety lever 20 which is a pivotable about pin 27 adjacent the rear end of the lever 20 and with the major portion of the lever being disposed forwardly thereof. Accordingly, the majority of the mass of the lever 20 will, whenever the gun is positioned in its normal firing orientation, be such as to cause the force of gravity to swing the lever 20 clockwise toward its "safe" condition. Thus, even if the safety spring 21 should fail for some unexpected reason, the weight distribution of the lever 20 will nevertheless tend to cause the lever to rotate clockwise so that its downwardly opening recess will engage the pin 32 and prevent the firing mechanism being operated to fire the gun.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described our invention, what is claimed is:

1. Magazine safety for a semi-automatic pistol having a frame including a muzzle end and a rear end and which provides for disposition of a trigger and a trigger spring, a grip for holding the pistol for firing and including a downwardly open magazine chamber therein for releasably receiving therein a magazine, a double action firing mechanism including a striker type firing pin with a firing pin spring disposed thereon operable in response to firing movement of the trigger and a depending leg portion releasably engageable by a pivotable sear, a trigger bar extending from the trigger and engageable with the sear to move the sear rearwardly to cock the firing pin spring and to release the leg portion of the firing pin, the improvement comprising a lever including a forward end and an after-end and being pivotable on the frame at a point adjacent the after-end of the lever and including a downwardly opening recess adjacent the forward end of the lever for engaging the sear to prevent the movement of said sear in response to movement of the trigger, said lever including a portion thereof engageable with the magazine when inserted into the magazine chamber of the pistol so that the lever is pivoted upwardly sufficiently to disengage the recess of the lever from the sear, and a safety spring releasably urging the lever downwardly against the trigger spring.

2. Magazine safety as set forth in claim 1, and in which said sear includes a pin extending laterally from the sear and is releasably engageable by the recess in the lever, and in which said after end of the lever is pivotable about a pin disposed adjacent the rear end of the pistol.

3. Magazine safety as set forth in claim 2, in which said lever has a configuration such that its center of gravity relative to the point which is pivotably mounted to the frame is located such that the lever will be acted upon by gravity to return to its sear engaging position in the event said safety spring fails to function.

* * * * *